United States Patent [19]

Lautenschläger, Jr. et al.

[11] Patent Number: 4,500,140

[45] Date of Patent: Feb. 19, 1985

[54] SLIDE FOR DRAWERS AND THE LIKE

[75] Inventors: Karl Lautenschläger, Jr.; Horst Lautenschläger, both of Reinheim, Fed. Rep. of Germany

[73] Assignee: Karl Lautenschläger KG, Möbelbeschlagfabrik, Reinheim, Fed. Rep. of Germany

[21] Appl. No.: 545,682

[22] Filed: Oct. 26, 1983

[30] Foreign Application Priority Data

Oct. 28, 1982 [DE] Fed. Rep. of Germany ..... 3239956

[51] Int. Cl.[3] ..... F16C 29/04

[52] U.S. Cl. ..... 308/3.8

[58] Field of Search ..... 308/3.8, 3.6, 6 R, 3 R; 312/350

[56] References Cited

U.S. PATENT DOCUMENTS 4,018,488 4/1977 Manson ..... 308/3.8
4,045,097 8/1977 Röck et al. ..... 308/3.8
4,199,200 4/1980 Livingston ..... 308/3.8
4,440,462 4/1984 Manson ..... 308/3.8

*Primary Examiner*—Lenard A. Footland

[57] ABSTRACT

A slide for drawers and the like, to be provided in pairs on opposite sides of a drawable furniture part and an associated carcass wall. It has a profiled cabinet rail (26) to be connected to the carcass wall (14) and a drawer rail (18) to be connected to the drawer. At the front end of the cabinet rail and at the rear end of the drawer rail there is rotatably journaled a roller (32;24) running on the drawer and cabinet rail respectively. An adjusting key (34) is longitudinally displaceably arranged at the cabinet rail and rests against the drawer rail. The connection of the key at the cabinet rail is such that, upon longitudinal displacement, a displacement component transverse to the drawing direction is superimposed on it, whereby an adjustment of the transverse play of the drawer between the carcass walls is possible.

13 Claims, 13 Drawing Figures

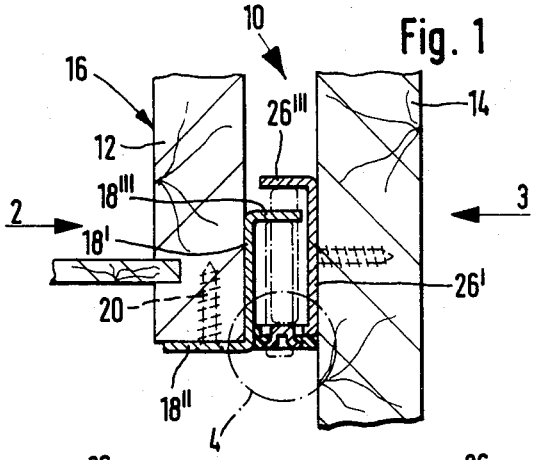
Fig. 1
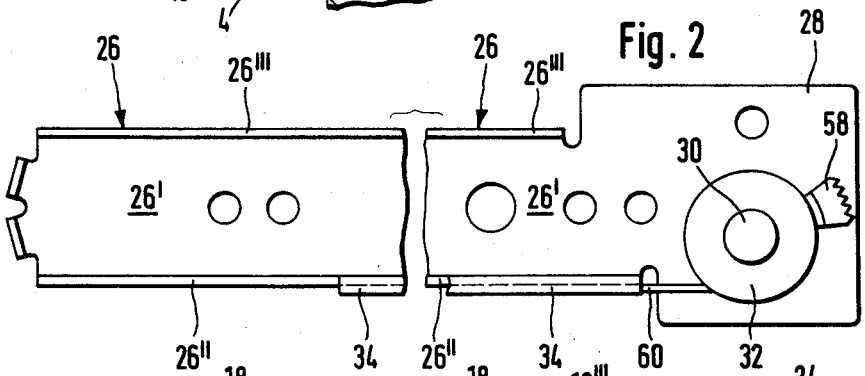
Fig. 2
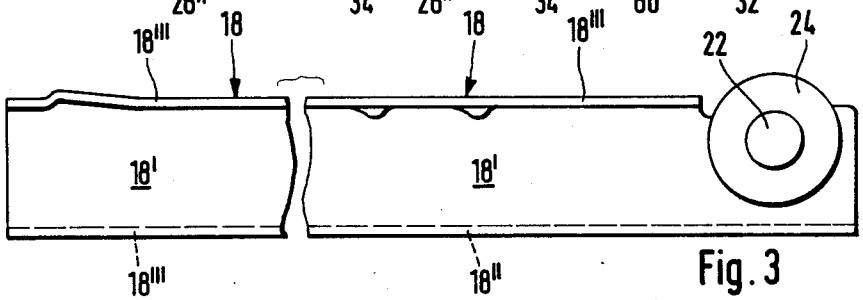
Fig. 3
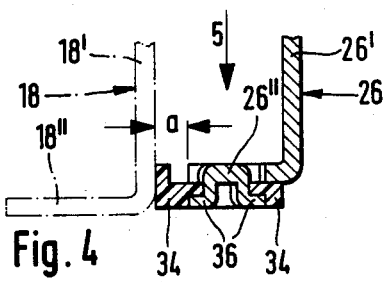
Fig. 4
Fig. 5
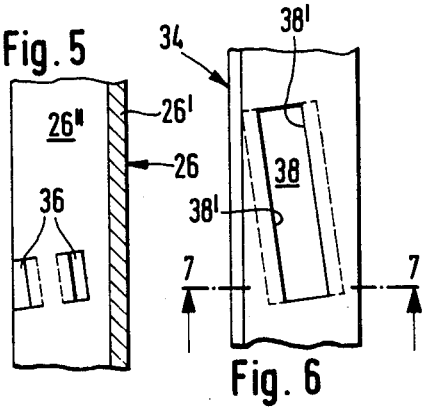
Fig. 6
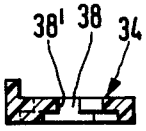
Fig. 7

Fig. 8
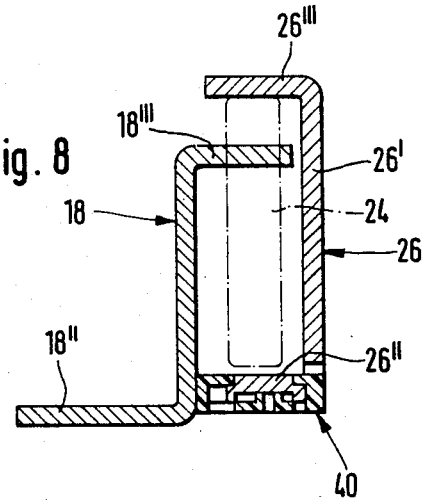
Fig. 9
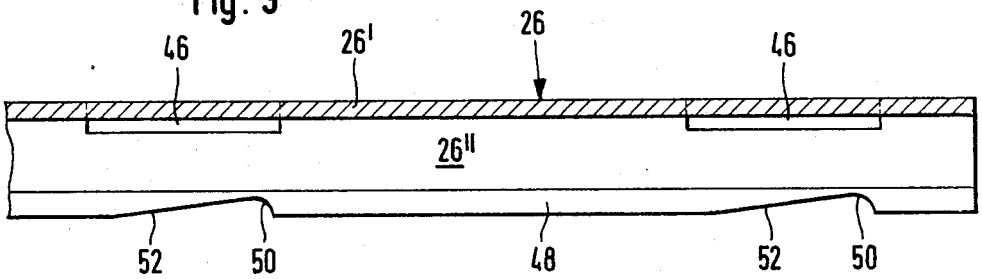
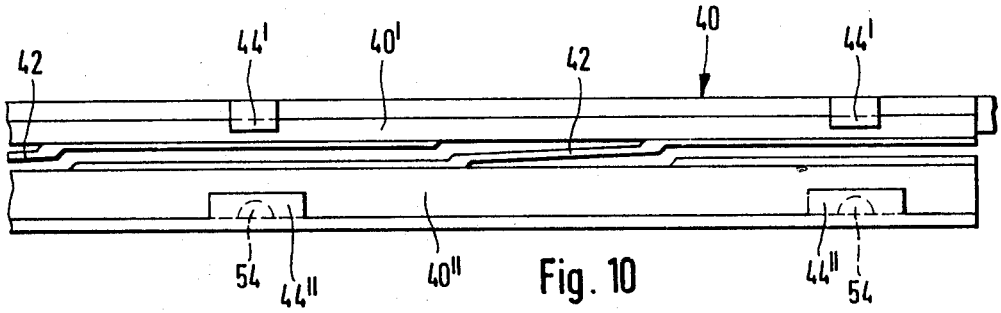
Fig. 10

26
28
18
32
58
24
30
34(40)
60

26
28
56
58
34(40)
60
62
64

12
18'
18
68
18''
72
70
74
76

SLIDE FOR DRAWERS AND THE LIKE

BACKGROUND OF THE INVENTION

The invention relates to a slide for drawers and other such parts of furniture, having a rail of a certain cross-sectional profile which can be fastened to the drawer carrying wall of the cabinet carcass, and which shall be referred to hereinafter as the cabinet rail, and a rail of a different cross-sectional profile which can be fastened to the drawer or the like, referred to hereinafter as the drawer rail, these rails being displaceable relative to one another by means of at least one wheel journaled on the front end of the drawer rail, and at least one wheel journaled on the cabinet rail, an adjuster which thrusts against the drawer rail being provided on the cabinet rail and permitting adjustment of the sideplay of an associated cabinet drawer.

Drawer slides of this kind are enjoying increasing popularity in modern furniture, especially when used in pairs on opposite sides of drawers, appliance platform drawers, cutting boards and the like, on account of the reduced effort required to draw them out, in comparison to friction slides. In the manufacture of furniture, inaccuracies are constantly encountered in the width dimensions of the drawers and in the distance between the walls of the drawer compartments in the cabinet. These inaccuracies do not impair the operation of the slides, because the wheels are able to shift on their associated rail flanges, but the drawer can become displaced in the transverse direction, so that, for example, the vertical edges of the drawer fronts of a plurality of drawers mounted one above the other will no longer be in line, which results in a less-than-pleasing appearance. Furthermore, the lateral guidance of the drawer is poor, especially as the drawer is drawn further out of its compartment. A drawer drawn all the way out has a side play which can amount to considerably more than one centimeter, on account of the fact that the wheels of the cabinet rails and drawer rails are too close together. A known measure for eliminating this side play is to mount drawers with two different slides on the opposite sides of the drawer; the rail flanges associated with the wheels of one slide are configured such that they overlap the rims of the wheels, so that no lateral displacement of the wheels on the corresponding rail flanges is possible in this drawer slide. On the other hand, however, the total inaccuracy of the width of the drawer and of the walls of the drawer compartment is transferred to the opposite drawer slide on which, accordingly, rails whose flanges overlap the rims of the wheels cannot be used. The drawers then are not located precisely in the center between the carcass walls, and they will have an untidy appearance, especially when a cabinet door of the same width as the doors is mounted above or below the drawers, because then it will be out of alignment with the drawers. When fully drawn out of their recess, drawers of this kind are unsteady, also on account of the above-mentioned short distance between the wheels, even if on the front end of the cabinet rails of the laterally unguided slide there is provided a means for the adjustment of sideplay, which is in the form of a disk journaled on the wheel axle and having a circumferential ramp which, in accordance with the rotational position of the disk, wedges itself between the side of the drawer rail and fills the gap in this area of engagement. Since this adjusting means, however, acts, as stated, at only one point, namely in the area of the front end of the cabinet rail, it cannot substantially improve the lateral steadiness of a drawer when the latter is drawn very far out of its recess. And it is entirely impossible to center the drawer with such an adjusting means disposed on only one side.

It is therefore the object of the invention to create a slide for drawers and the like, which will permit a better equalization of sideplay such that no sideplay will be produced even when the drawer is drawn all the way out. Furthermore, the drawer slides, when used in pairs, one on each side of the drawer, are also be permit transverse alignment of the drawer by contrary adjustments of the equalization means.

SUMMARY OF THE INVENTION

Setting out from a drawer slide of the kind mentioned in the beginning, this object is achieved by the invention in that the adjusting means is an elongated key held for longitudinal displacement on the cabinet rail, whose edge remote from the supporting wall abuts against the drawer rail, and that the edge of the key abuts against at least one adjustment surface or edge of the cabinet rail, which is at an angle to the line of drawer movement, such that when the adjusting means is displaced lengthwise it will create a transverse component of displacement. In other words, the key edge can be brought by the combination of longitudinal and transverse displacement into abutment against the drawer rail all along the area in which the cabinet rail and drawer rail confront one another, thus eliminating the transverse instability of a drawer mounted on such slides in a cabinet carcass, even in the fully drawn state. By the contrary adjustment of the cabinet rails of a cooperating pair of drawer slides, the desired transverse adjustability of the drawer between the walls supporting the drawer is also achieved.

In a drawer slide having a cabinet rail of channel-shaped cross section whose web can be fastened to the drawer supporting wall of a cabinet carcass, and whose flanges projecting away from the web at right angles thereto form the tracks for the wheel mounted on the drawer rail, and having a drawer rail with a web laid against the drawer, from which a flange projects at right angles to the drawer rail, thereby forming a track for the wheel mounted on the cabinet rail, it is desirable to mount the adjusting means at the bottom of the lower cabinet rail flange, with its edge abutting against the web of the drawer rail.

For the adjustable mounting of the adjusting key on the cabinet rail, the key and the flanges on which it is mounted have interacting projections and slots, respectively, the projections being held displaceably in the slots which run in the direction of adjustment of the key.

The projections can be formed by tabs cut and bent outwardly from the material of the flange of the cabinet rail, and can engage the associated slots provided in the adjusting key.

Alternatively, the slots can be stamped out of the flange of the cabinet rail, in which case the tabs provided on the adjusting key reach around their edges, although care must be taken to see that these tabs do not extend into the path of the wheel running on the flange.

The adjusting key is preferably made of plastic by injection molding, in which case the slots for engagement by the tabs or the projections for engagement in the slots in the flange, as the case may be, can be injection molded in one piece therewith.

In further development of the invention, the key can also be divided longitudinally at the approximate center into two parallel strips joined together by resiliently flexible webs, and projections are provided on the strip confronting the drawer rail and extend around ramp edges of the associated openings in the flange of the cabinet rail, and projections are provided on the strip section remote from the drawer rail which extend around edges running parallel with the rail of the associated openings in the flange of the cabinet rail. When this strip is acted upon for adjustment, its longitudinal displacement will simultaneously displace the other strip adjacent the cabinet rail in the transverse direction, without performing any transverse movement itself. This is made possible by the fact that the strips are joined together by resiliently elastic bridges.

The strips are preferably injection molded integrally with the resiliently flexible bridges and projections from a plastic of a resiliently flexible kind. The front end of the key, which is accessible when the drawer is fully extended, is best provided with a handle for its displacement or is joined to such a handle, which makes it possible to adjust the key with the drawer open.

In a preferred embodiment of the invention, the handle is formed at the free end of a lever mounted on the axle of the wheel journaled on the front end of the cabinet rail, this lever then being operatively connected to the front end of the key. It is desirable to provide this connection in the form of a stiff web or the like coupling together the free end of the key and the lever bearing the handle, the web being attached to the lever at a distance from the fulcrum point of the latter.

If the key is made of plastic, it is desirable to make it in one piece with the lever and the web by injection molding from plastic.

Since the connecting web must translate the movement of the lever into a rectilinear displacement of the key, it is subjected to pressure and tension forces by the adjustment, on the one hand, and to a bending deformation. To make the web sufficiently flexible for this purpose, and on the other hand to prevent it from buckling when it transmits thrust, it is best to provide it with positive guidance between its extremities.

BRIEF DESCRIPTION OF THE DRAWING

The invention is explained in the following description of two embodiments, in conjunction with the drawings, wherein:

FIG. 1 is a front cross-sectional view through a first embodiment of a drawer slide in accordance with the invention, FIG. 2 is a side elevational view of the drawer slide, seen in the direction of the arrow 2 in FIG. 1, FIG. 3 is a side elevational view of the drawer rail of the drawer slide, seen in the direction of arrow 3 in FIG. 1, FIG. 4 shows on an enlarged scale the area of the drawer guide situated within the circle drawn in broken lines in FIG. 1, FIG. 5 shows a section of the bottom flange of the cabinet rail of the drawer slide, seen in the direction of the arrow 5 in FIG. 4, FIG. 6 is a view of a section of the adjusting key displaceably disposed on the bottom of the rail shown in FIG. 5, again as seen in the direction of the arrow 5 in FIG. 4, FIG. 7 is a side view seen in the direction of the arrows 7—7 in FIG. 6, FIG. 8 is a cross section through a second embodiment of a drawer slide in accordance with the invention, taken across the length of the slide, FIG. 9 is a top plan view of a section of the lower flange of the cabinet rail of the drawer slide shown in FIG. 8, FIG. 10 is a top plan view of a section of the adjusting key displaceably disposed on the bottom of the flange shown in FIG. 9.

DETAILED DESCRIPTION OF PREFERRED EMBODIMENTS

Figure 11:
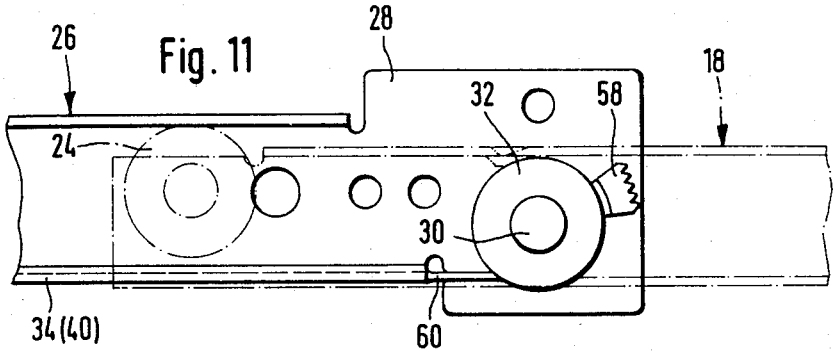
FIG. 11 is a side view of the front end portion of the cabinet rail of a drawer slide of the invention, the drawer rail being shown in broken lines in the fully extended position.
Figure 12:
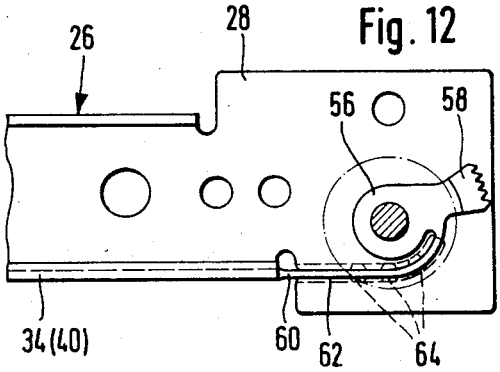
FIG. 12 is a side view corresponding to FIG. 11 of the front end portion of the cabinet rail, the wheel journaled on the cabinet rail in this end portion being indicated in phantom.

In FIG. 1 there is shown in cross section a drawer slide designated as a whole by the number 10, it being assumed that the slide serves for guiding the side 12 of a drawer on the associated wall 14 of a cabinet. On the opposite side of the drawer and the corresponding cabinet wall, which are not shown, the components of the drawer slide to be provided on that side are mirror-images of, but otherwise identical in construction with the components of drawer slide 10.

The drawer slide 10 has an elongated, channel-shaped drawer rail 18 which can be fastened to the side of the drawer (see also FIG. 3), having two flanges 18'', 18''' bent away at right angles in opposite directions from a web 18'. The drawer rail 18 is fastened to the side of the drawer 14 such that the flange 18' lies against the surface thereof facing the cabinet wall 14, and the bottom flange 18'' lies against the bottom edge of the drawer side 12, the drawer rail being fastened to the drawer side 12 by screws 20 driven through holes in the flange 18'' into the edge of the drawer side. On the back end of the drawer rail 18, which is on the right in FIG. 3, a wheel 24 journaled on an axle 22 riveted to the web 18' and extending toward the cabinet wall is provided, whose circumference extends slightly above the upper flange 18''' of the drawer rail 18, which is cut away in this end area.

The wheel 24 rolls on tracks on the cabinet rail 26 (see also FIG. 2) which is channel-shaped and has two flanges 26'' and 26''' bent away at right angles in the same direction from a web 26' which is screwed against the cabinet wall 14. The distance between the inside surfaces of the flanges forming the track for the wheel is approximately equal to or only slightly greater than the diameter of the wheel 24. The wheel therefore rolls on the inside face of the lower or upper flange 26'' or 26''', according to how far out the drawer has been drawn. At the front end of the cabinet rail 26, the flanges 26'' and 26''' are cut away, and the web 26' is enlarged to form a journal plate 28, in which a stub axle 30 projecting toward the drawer side 12 is riveted, and a wheel 32 is journaled on this axle and rolls on the bottom side of the flange 18''' of the drawer rail 18. On the bottom of the lower flange 26' of the cabinet rail 26, a key 34 of plastic is fastened adjustably in the manner to be further explained below in conjunction with FIGS. 4 to 7, such that the edge of the key 34 facing the drawer lightly touches the web 18' of the drawer rail 18, so that the web 18 slides along the key when the drawer is opened and closed.

The key 34 is disposed displaceably on the flange 26", tabs 36 being cut free from the material of the flange and bent downward from the plane of the flange in a hook-like manner. In FIGS. 4 and 5 two such hook-like tabs 36 are shown, pointing in opposite directions. Actually, several such pairs of tabs are provided, which are spaced lengthwise of the cabinet rail, each engaging the undercut margins 38' of slots 38 provided in the adjusting key 34. The slots 38, however, do not run precisely parallel with the cabinet rails but, like the associated hook-like tabs 36, are set at an angle thereto, as indicated in FIGS. 6 and 5. When the adjusting key 34 is displaced relative to the cabinet rail 26 toward the interior of the cabinet, the key is therefore simultaneously displaced toward the web 18' of the drawer rail 18 and then spans any gap a which may be present due to inaccuracies in the manufacture of the drawer or cabinet carcass between the edge of the flange 26" of the cabinet rail 26 and the web 18' of the drawer rail 18. If, on the other hand, the key 34 is pulled outwardly from the cabinet interior, it is simultaneously retracted from engagement with the web 18. It is thus clear that, by a simple displacement of the key 34 relative to the cabinet rail 26, any gap a that may be present can be closed up or enlarged. Consequently, it is possible to compensate any sideplay that may be present and also to transversely align a drawer mounted with the drawer slides 10 in a cabinet carcass, by shifting the keys 34 on the opposite sides 12 of the drawer in opposite directions such that the drawer is shifted to the desired aligned position.

In FIGS. 8 to 10 there is shown an embodiment of the drawer slide of the invention which differs as regards the displaceable mounting of the key on the cabinet rail. The key 40 in this case is divided lengthwise into two parallel strips 40' and 40", which are joined together by resilient bridges 42 in such a manner that they can be drawn apart against the resilient bias of the bridges. On the upper side of both halves 40' and 40" of the key, hook-like projections 44' and 44" are provided along its length, which engage slots 46 running precisely in the direction of drawer movement, in the transitional area between the flange 26" and the web 26' of the cabinet rail 26 on the one hand and the free margin 48 of the flange on the other hand, and they are bent over so as to be parallel to the plane of the flange 26". In the area of engagement of the projections 44", ramp-like indentations 50 are cut, which are engaged each by a semicircular stub 54. When the key 40 is displaced relative to the cabinet rail 26, the stubs 54 slide on the edges 52 of the indentations 50, and the strip 40" changes its distance from the strip 40' by flexing the bridges 42. The edge of the strip 40" facing the web 18' of the drawer rail 18 is thus displaced again in the crosswise direction, and the desired compensation of sideplay is thus achieved. Unlike the embodiments described before, therefore, only a part of the key 40, namely the strip 40" is adjusted transversely, while the strip 40' is moved only in the direction of the drawer movement. The key 40 is desirably made of plastic, in which case the strips 40' and 40" with the resilient bridges 42 as well as the projections 44' and 44" are molded integrally together.

To permit the adjustment of the adjusting keys 34 in the one embodiment and 40 in the other, it is sufficient, basically, to grasp the key by the front end, which is provided if desired with a knob-like grip, and push it in or pull it out according to the direction of adjustment desired. But since this operation would have to be performed underneath the at least partially extended drawer, and this area is not at all accessible in the case of a drawer directly against the bottom of the cabinet, an adjusting means 56 is provided, which has a handle 58 which is accessible at the front end of the cabinet rail beside the drawer side 12 when the drawer is pulled open. The adjusting means 56 is formed in practice by a lever fulcrumed on the axle 30 between the journal plate 28 and the wheel 32 of cabinet rail 26, and the handle 58 is formed on its end projecting beyond the circumference of the wheel 32. The lever 56 is connected by a web 60 to the front end of the key such that the operation of the handle is transformed by the web 60 into a displacement of the key 34 or 40, as the case may be. Since for the sake of economy of manufacture the key is made integrally of plastic with the web 60 and the adjusting means 58, the web 60 must be flexible so as to be able to convert the turning movement of the lever 56 to the longitudinal movement of the key. To prevent the web from buckling under thrust instead of converting the rocking movement to a longitudinal displacement of the strip, it is guided against buckling in a conforming groove 62 in the journal plate 28, one or more guiding studs 64 being made integral with the web 60 and being engaged in the conforming groove 62 in the journal plate 28. Alternatively, tabs could also be cut from the journal plate in an appropriate place and bent outwardly at right angles, and these could alternately engage opposite sides of the web 60.

Figure 13:
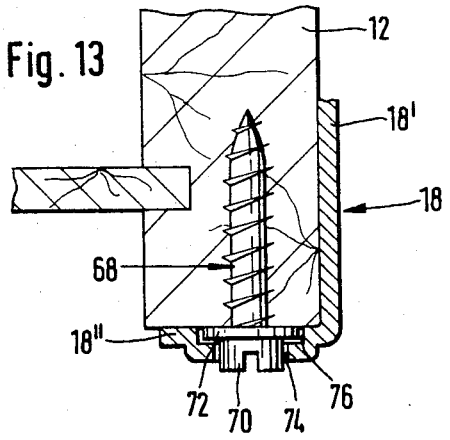
FIG. 13 is a partial cross-sectional view through the bottom end portion of a drawer side and the flange of the rail of a drawer slide of the invention, on which it is mounted.

In addition to the compensation of sideplay and the transverse alignment of a drawer, it may sometimes also be necessary to adjust the front of a drawer vertically. Such a possibility of adjustment is represented in FIG. 13. If the flange 18" of the drawer rail 18 placed under the bottom edge of the drawer side 12 is firmly screwed to the latter with screws 20 in the back part in the manner described, the front part of the drawer rail 18 is sufficiently resilient to be lifted away from the edge of the drawer by an adjusting screw 68. It is desirable to configure the adjusting screw in the manner represented in FIG. 13 such that it has a cylindrical head 70 having a radially projecting annular flange 72 adjacent the screw body. The cylindrical head 70 is exposed rotatably in a hole 74 in the flange 18", so that the blade of a screwdriver can be applied to it to turn the adjusting screw 68, while the annular flange 72 is received in an associated boss 76 surrounding the hole 74. When the adjusting screw is turned such that the threaded body unscrews out of the drawer side 12, the annular flange 72 contained in the boss 76 presses the flanges 18" down away from the edge of the drawer side, thus causing the drawer, and with it its front, to be displaced upwardly relative to the flange.

We claim:

1. A guide for a drawable cabinet part, comprising: an elongated profiled guiding rail having a front and rear end and to be fastened to a cabinet carcass, an elongated profiled running rail having a front and a rear end and to be fastened to the drawable cabinet parts, at least one wheel journalled on said guiding rail at said front end thereof, and at least one wheel journalled on said running rail at said rear end thereof, each wheel running on a profile limb of the other rail, said rails being displaceable relative to one another by means of said wheels, and adjusting means disposed on said guiding rail and resting on said running rail for adjusting lateral play of said drawable cabinet part with respect to said carcass, said adjusting means being an elongated guiding strip held on the guiding rail and longitudinally displaceable in the drawing direction of the drawable part, said adjusting means having a surface facing away from said carcass and lying against said running rail, said guiding rail having at least one adjusting surface or edge for supporting said guiding strip and which runs at an angle to the drawing direction, such that a component of displacement transverse to the drawing direction is superimposed on said guiding strip upon displacement in said drawing direction.

2. A guide according to claim 1, said guiding rail being of U-shaped cross section with a web surface to be fastened to the cabinet carcass, and with upper and lower profile limbs projecting at right angles from said web surface and having inside confronting surfaces forming tracks for said wheel mounted on said running rail, said running rail having a web surface to lie against the drawable cabinet part and a profile limb forming a track for said wheel mounted on said guiding rail and projecting from said web surface of said running rail and at right angles to said guiding rail, said guiding strip being mounted on said lower profile limb of said guiding rail and its surface facing away from the carcass lying against said web surface of said running rail.

3. A guide according to claim 2, wherein said guiding strip and said lower profile limb of said guiding rail have projections and openings respectively which engage one another, the projections being held displaceably in the openings, the openings being elongated in the direction of adjustment of the guiding strip.

4. A guide according to claim 3, wherein said projections are formed by tabs cut free and bent out from said lower profile limb of said guiding rail, said tabs reaching under the edges defining the openings in the direction of adjustment of the elongated openings in said guiding strip.

5. A guide according to claim 3, wherein said openings are stamped out of the lower profile limb of said guiding rail and edges defining the openings and running in the adjustment direction are reached around by said projections on said guiding strip.

6. A guide according to claim 5, wherein said guiding strip is divided longitudinally in the approximate center thereof into two elongated, parallel strip sections which are joined together by resiliently flexible tongues, projections provided on the strip section facing said running rail reaching around defining edges, running at an angle to the drawing direction, of the associated openings in the lower profile limb of said guiding rail, and projections provided on the strip section facing away from said running rail reaching around defining edges, running in the drawing direction, of the associated openings of said lower profile limb of said guiding rail.

7. A guide according to claim 6, wherein said strip sections, said resiliently flexible tongues, and said projections are an integral piece of plastic.

8. A guide according to claim 1, wherein said guiding strip is a piece of plastic.

9. A guide according to claim 1 or 6, comprising a handle connected to said guiding strip for displacing the same.

10. A guide according to claim 9, wherein said handle is formed on the free end of a lever fulcrumed on the axle of said wheel journalled on said guiding rail, said lever being operatively connected with said guiding strip.

11. A guide according to claim 10, comprising a joining section coupling said guiding strip and said lever, said joining section being connected to said lever at a distance from the fulcrum axis of said lever.

12. A guide according to claim 11, wherein said guiding strip, said lever and said joining section are an integral, injection-molded piece of plastic.

13. A guide according to claim 12, comprising means for protecting said joining section between its extremities against buckling.

* * * * *